United States Patent [19]

Bartlett et al.

[11] Patent Number: 4,545,693

[45] Date of Patent: Oct. 8, 1985

[54] DRIVE FOR THERMAL PRINTING LIFT-OFF CORRECTION

[75] Inventors: John C. Bartlett; Alan E. Bohnhoff, both of Lexington; Donald F. Croley, Georgetown; Stanley Dyer, Lexington; Kenneth E. Edds, Versailles; Frank J. Horlander; Donald W. Stafford, both of Lexington, all of Ky.

[73] Assignee: International Business Machines Corporation, Armonk, N.Y.

[21] Appl. No.: 540,967

[22] Filed: Oct. 11, 1983

[51] Int. Cl.[4] ..... B41J 3/00

[52] U.S. Cl. ..... 400/120; 400/696

[58] Field of Search ..... 101/93.03; 400/120, 400/695, 696, 697, 697.1, 700

[56] References Cited

U.S. PATENT DOCUMENTS

| | | | |
|---|---|---|---|
| 4,350,449 | 9/1982 | Countrymen et al. | 400/120 |
| 4,384,797 | 5/1983 | Anderson et al. . | |
| 4,396,308 | 8/1983 | Applegate et al. . | |
| 4,434,356 | 2/1984 | Craig et al. . | |

FOREIGN PATENT DOCUMENTS

| | | | |
|---|---|---|---|
| 0066241 | 6/1978 | Japan | 400/697 |
| 0090381 | 7/1980 | Japan | 400/120 |
| 0195673 | 12/1982 | Japan | 101/93.03 |
| 0038178 | 3/1983 | Japan | 400/120 |

OTHER PUBLICATIONS

*IBM Technical Disclosure Bulletin*, article entitled "Thermal Printed Energization Circuit", vol. 24, No. 7B, Dec. 1981, at pp. 3968-3970.

*Primary Examiner*—Edgar S. Burr
*Assistant Examiner*—John A. Weresh
*Attorney, Agent, or Firm*—John A. Brady

[57] ABSTRACT

Ribbon (22) in thermal printing has an outer layer which adheres to printed characters at intermediate temperatures, lower than printing temperatures. The printhead (7) has a column of electrodes (9) which sweep across the character area. Lift-off is accomplished by the pattern control (40) controlling the current source (38) to provide rapid, square wave pulses displaced in phase 180 degrees at adjoining electrodes (9). The high level of the pulses is about that of the level at printing, and the pulses are sufficiently rapid so that their net effect is to raise the outer layer ribbon (22) to the intermediate temperature. At areas corresponding to underlines of characters, duration of the up period is longer. Good, long term reliability is achieved by the significant erase level being very close to the print level.

20 Claims, 5 Drawing Figures

DRIVE FOR THERMAL PRINTING LIFT-OFF CORRECTION

DESCRIPTION

1. Technical Field

This invention relates to lift-off correction of thermal printing.

This is an improvement and modification in the field of thermal lift-off correction described and claimed in U.S. Pat. No. 4,384,797 to Anderson et al, which is assigned to the same assignee to which this application is assigned. The outer layer of a ribbon adheres to printing at temperatures intermediate between room temperatures and printing temperatures. After some cooling, a bond exists between printing and the ribbon by which the printing is lifted away as the ribbon is moved from contact with the printing.

2. Background Art

The foregoing U.S. Pat. No. 4,384,797 to Anderson et al describes and claims generically this lift-off correction at intermediate temperatures. U.S. Pat. No. 4,396,308 to Applegate et al, also assigned to the same assignee to which this application is assigned, describes a guide on a pivoted arm which is moved at lift-off correction to a position which holds the ribbon to the printing past the print position to allow a bond to set.

This invention involves a series a rapid drive pulses during correction. Nothing in the prior art is known which teaches such pulsing during correction.

DISCLOSURE OF THE INVENTION

In a thermal printer employing a ribbon suited for erasure by intermediate heat, this invention employs a pulsed drive pattern for erasure, the net effect of which provides the intermediate heat. In the preferred implementations the pulses are of equal zero and high duration, with the high level being generally the same as the print level. Improved functioning is realized, which appears to result from interface effects and the like being closely similar because the printing level and significant erase level are closely similar. Significant variables in electrical parameters, including machine and ribbon tolerances, are neutralized.

More specifically, in the preferred embodiment the overall erase pattern corresponds to a checkerboard, with the erase thereby being a block erase. Levels corresponding to positions of underlines receive a somewhat higher net energy as that has been found desirable for removing underlines.

BRIEF DESCRIPTION OF THE DRAWING

The printing system and operation are illustrated by the drawing in which.

BEST MODE FOR CARRYING OUT THE INVENTION

Figure 1:
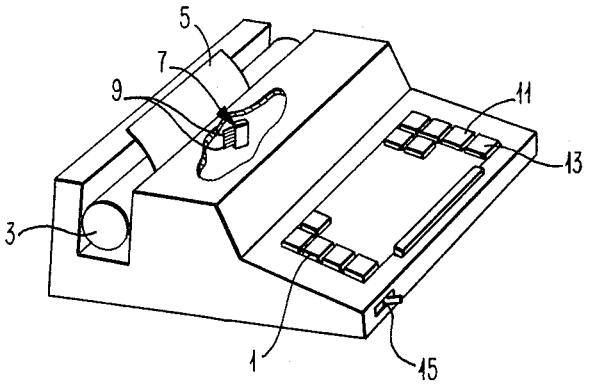
FIG. 1 is illustrative of a typewriter system in representative form.

As shown illustratively in FIG. 1, the printer is a typewriter having the usual keyboard 1, a platen 3 upon which paper 5 to be printed upon is supported and a thermal printing element or printhead 7 with a group of small electrodes 9 to effect printing of a selected character image and to conduct lift-off correction.

One of the keybuttons 11 effects ordinary backspacing while another keybutton 13 effects erasure operations to be described. Sequencing and other control of typewriter operations and internal functions in response to operation of keyboard 1 is under control of electronic logic and digital processing systems as is now conventional in general respects in electronic typewriters. Preferably, virtually all control is provided by one or more microprocessors which are an internal, permanent part of the typewriter of FIG. 1.

In FIG. 1, the printhead 7 is shown broken away on the side toward keyboard 1. The remaining structure is sufficiently indicated in FIG. 2. Toward the platen 3, the supporting structure of printhead 7 is shown broken away to emphasize the single vertical row of electrodes 9 which are mounted within the printhead 7. During normal operation, each electrode 9 may be connected to a high energy source or not so connected, depending on the pattern selected for heating by the printhead 7.

The machine has a control 15 by which an operator may set the level of power to the electrodes 9 within a predetermined range. Where, for example, printing appears lighter than desired, control 15 is adjusted. The effect is to increase power to electrodes 9. Control 15 automatically varies the erase power directly with the print power.

Figure 2:
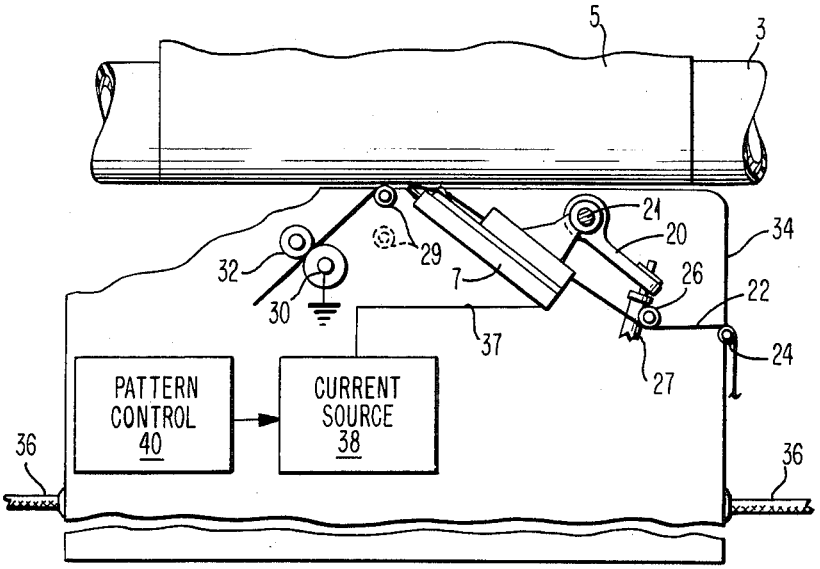
FIG. 2 is a top view of such a system.

FIG. 2 is a top view, also generally illustrative only, of the printing and erase area. Positioning member 20, pivoted at point 21, is attached to printhead 7. Ribbon 22 is directed around tensioning roller 24, across a guide roller 26, and to the end of printhead 7. Link 27 engages an arm of member 20, and, when moved away from platen 3 (the position shown in FIG. 2), link 27 pulls member 20 clockwise to force the end of printhead 7 against paper 5 mounted on platen 3. Link 27 is moved the opposite direction to move printhead 7 away from paper 5.

When link 27 is in the outward position shown in FIG. 2, ribbon 22 is pressed between the end of printhead 7 and paper 5. Ribbon 22 is then in contact with the ends of the vertical column of electrodes 9 (FIG. 1), which are mounted in printhead 7. A guide member 29 is selectably movable toward and away from platen 3. During correction, guide member 29 is moved toward platen 3 to present a face at paper 5 a preselected distance prior to the printing position. Ribbon 22 is thereby positioned flat with paper 5 at the printing point and for the preselected distance prior to the printing point. In a typical printing operation, the preselected distance is the width of at least two characters.

Metering of the ribbon 22 is effected by cooperating rollers 30 and 32 located on the take-up side of printhead 7. Roller 30 may also constitute a connection to ground. The printhead 7, arm 20, guide rollers 24 and 26 and metering rollers 30 and 32 are mounted on a carrier 34 which moves across the length of a stationary plate 3 under forces provided by belt or cable 36.

An electrical lead, shown illustratively as a single wire 37, connects to electrical power source 38. Power source 38 may be any system or circuitry suited to selectively drive the desired patterns of electrodes 9 with the predetermined power level. A specific circuit particularly suitable as source 38 is described in U.S. Pat. No. 4,434,356, filed Dec. 22, 1982, by T. P. Craig et al and assigned to the same assignee to which this invention is assigned. Two aspects of that circuitry of particular interest with respect to this invention is that the level of input drive may be selected by setting a single reference level potential, denominated Vlev, and the drive to each electrode 9 is selected or not selected under control of a single input potential, denominated Vsel. Where the Vsel signal is at the non-select level, the drive circuit to the associated electrode is simply inactivated or "switched off."

The final element shown in FIG. 2 is the pattern control system 40. Typically, this is provided as an ordinary function of a general purpose data processor, specifically a microprocessor. As is described in detail below, the pattern control for this invention provides a predetermined configuration of off and on signals for each electrode 9 to drive and not drive electrodes 9 in accordance with a repetitive, rapidly varying scheme. The production of preselected binary signals under close timing restraints is standard capability of a microprocessor, which may be implemented routinely, and will not be discussed in further detail. Details of implementation will be different depending upon the many alternatives which can be selected as to achieve the same objectives of storing, transferring, arranging data and the like and depending upon the many minor differences in fundamentally similar hardware which might be employed. The details of programming to achieve pattern control 40 form no part of this invention.

The ribbon 22 is a laminated element having an outer layer of thermoplastic, pigmented marking material which may be 4 to 6 microns in thickness, an aluminum intermediate layer which may be 1000 Angstrom in thickness serves as current return path, and a resistive substrate which may be 15 microns in thickness. The ribbon 22 is, of course, wide enough to fit across the entire vertical row of electrodes 9.

Printing typically is by complete release, and ribbon 22 must be incremented with each printing step. Printing is effected by energizing selected ones of the electrodes 9 while those electrodes 9 are in contact with the substrate of ribbon 22. The substrate of ribbon 22 is also in contact with a broad, conductive area, such as roller 30 connected to ground, which disperses current beyond the location of electrodes 9. The high current densities in the areas near the energized point electrodes 9 produce intense local heating which causes, during printing, melting of marking material and resulting flow onto the paper 5. During printing, guide member 29 is away from platen 3 so that the ribbon 22 is pulled away from paper 5 while still hot. During lift-off correction, guide member 29 is moved to paper 5 so that ribbon 22 is held against paper 5 in the span between printhead 7 and guide member 29. During lift-off correction, the net electrical energy is reduced, to thereby cause a heating which brings out adhesion of the outer, marking layer without flow from the ribbon 22.

Figure 3:
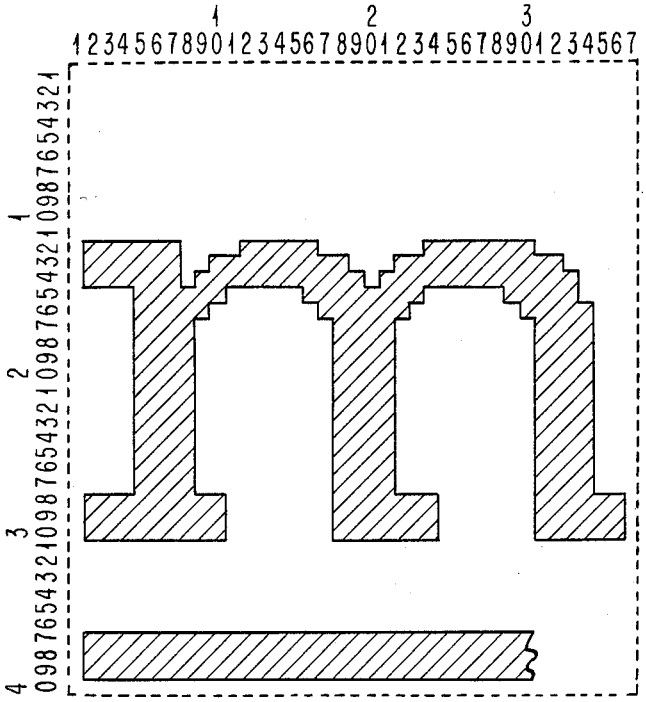
FIG. 3 is demonstrative of an area at which one printed character is to be erased.

The foregoing U.S. Pat. No. 4,384,797 is adequately illustrative of the type of ribbon 22 and the printing and basic erasing mechanism upon which this invention is an improvement or modification. FIG. 3 illustrates a row of 37 columns, across which the printhead 7 moves laterally during correction. The vertical row of forty electrodes 9 carried in printhead 7 are designated by the left vertical column of numerals, with each electrode 9 corresponding to a different one of the forty numerals shown.

The area shown is one column wider than the width of one character of a 10 pitch font. The 10 pitch designation defines characters having a width of one tenth of an inch. Each column is 1/360 inch in width. Accordingly, thirty-six of the columns define the width designated for one character. Where the character is 12 pitch, thirty of the columns define the width of one character. Each electrode 9 has an effective height of 1/240 inch.

This invention will be described assuming that the characters to be erased are 10 pitch with the left extremity of printing being in column 2. Corresponding applications of the invention to other size characters and graphics will be readily apparent.

In accordance with this invention, power from source 38 is applied in the timing and pattern described more specifically below as the electrodes 9 sweep past column 1. This application of power prior to the electrodes 9 being over printing allows the intermediate temperatures for erase to be reached before any part of a character is encountered. Power may be terminated after column 37.

Figure 4:
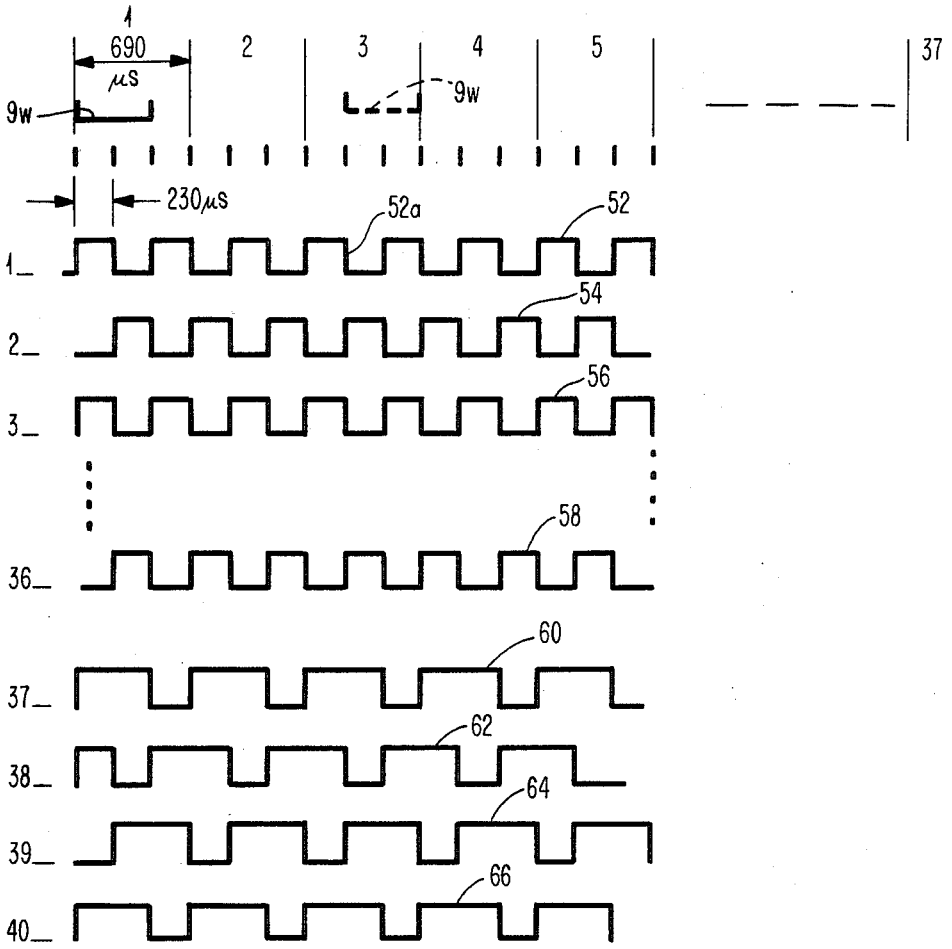
FIG. 4 is demonstrative of the timing of pulses in relation to the electrode position of a print electrode.

FIG. 4 illustrates timing and amplitude patterns provided by control 40. Columns 1 through 5, the left five columns of FIG. 3, are shown magnified with intermediate vertical lines corresponding to time. During a cycle of operation, printhead 7 continuously sweeps across a character area, traversing one column in 690 microseconds (μs). The effective physical width of each electrode 9 is two-thirds of a column or 1/240 inch. This width of an electrodes is illustrated in column 1 by the horizontal line marked 9*w*. The sweep speed is 690 μs per column. The effective width 9*w* of each electrode 9 will fully traverse a column, reaching the same relative position in an adjoining column, in 690 μs.

Square wave 52 traverses between current levels of zero and, in a typical embodiment, 23 milliamperes (ma), with each half cycle being 230 μs. The numbers at the left in FIG. 4 correspond to the same numbered electrodes in FIG. 3. The leftmost condition of FIG. 4 corresponds to the beginning or zero-time point in an erase operation. As time passes, the electrodes 9 move rightward at a rate of 690 μs per column. After 1610 μs, the electrodes are at the right side of column 3, the effective width 9*w* being shown in dotted outline. The square wave pulse 52 to electrode 1 is just at a downward transition labeled 52*a*.

Square wave 54 to the electrode 2 is identical to wave 52 except being one-half cycle different in time (180 degrees phase difference). Where wave 52 is supplying current, wave 54 is at zero. Where wave 54 is supplying current, wave 52 is zero. Wave 56 to electrode 3 is identical to wave 52. The signals to electrodes 4 through 35 are not shown since they alternate as do waves 52, 54 and 56 and are otherwise identical to waves 52, 54 and 56. Wave 36 is shown, which is identical to wave 54.

Square wave signals 60, 62, 64 and 66 to electrodes 37, 38, 39 and 40, respectively, are shown. The signals 60, 62, 64 and 66 are identical except that they are symmetrically displaced in time. Their high period is 67% of the total cycle time, thereby providing approximately 20% higher average current than the signal 52 driving electrode 1, and the corresponding signals driving electrodes 2 through 36.

At time zero, signal 60 to electrode 37 begins a 460 μs period when it is up. It is zero for the following 230 μs, followed by the up period for 460 μs. Signal 62 to electrode 38 is up at time zero for 230 μs, followed by a 230 μs down period, which is then followed by a 460 μs up period. The pattern of down for 230 μs followed immediately by up for 460 μs is repeated throughout the sweep of an area to be erased. Signal 64 is identical to signal 58 except that a 260 μs down period is initiated at time zero. Signal 66 is identical to signal 60.

The factors defining why erase of underlines is a special problem are not fully understood. Underlines are near an edge, where heating is less at the same inputs. Pealing from the platen 3 area at the bottom and top takes place earlier than pealing at the center when platen 3 is round and guide 29 is generally vertical, as is the case in this specific embodiment.

For printing, each column such as columns 1 through 37 where traversed by an electrode 9 is treated as a picture element (termed a PEL) which is printed as a unit as either light or dark. Since effective electrode height is two-thirds of column width, each PEL is rectangular. (FIG. 3 is illustrative and suggests square PELs, which are an alternative.) Dark printing is effected by applying the same level of current to electrode 9 during the full 690 μs interval when the effective area 9*w* symmetrically traverses a column. For printing, time zero is when the left side of the effective area 9*w* of the electrode 9 is on the left margin of a column, such as column 1. Drive is continued until the left side is on the left margin of the next column.

Such details of printing need not be duplicated during erasure in accordance with this preferred embodiment because the erasure effect is applied across the entire area or block in which a character might appear (termed block erase). Although erasure by forming an erase image corresponding to the character image avoids the opportunity for erase over a blank area to disturb the paper surface (often termed picking), this effect typically is nonexistent or negligible in thermal erase of the kind here involved. At the same time, sufficiently accurate registration for erasing over a printed character is difficult to achieve reliably as it involves movement of a relatively bulky printing mechanism with parts subject to changing adjustment and wear over a period of use. Accordingly, block erase as here described is the preferred mechanism for this invention, although nothing is known which prevents beneficial practice of this invention employing pulses as described applied only to those electrodes centered at least generally over the printed areas of the image to be erased. The drive pattern would be initiated one column prior to each column having printing so that initial warming effect corresponding to that in column 1 of the preferred embodiment can occur.

In this preferred printing operation, a character or symbol to be erased appears in the character area or block available for printing by electrodes 9, the PEL pattern for a lower case "m" being shown in FIG. 3 along with the left and central part of its underline. (Actual printed characters have rounded edges and other minor variations from the PEL images resulting from interactions and imperfection during actual heating and ink flow.) Column 1 is the column immediately prior to the first column in which a part of the printed image may appear. During an erase operation, printhead 7 sweeps across the character area. When the left side of the effective electrode area 9*w* is at the left side of column 1, all forty of the electrodes are driven in the pattern described in connection with FIG. 4. The pattern of the top 37 electrodes corresponds to that of a checkerboard. The lower four electrode have a similar pattern, but in which time of driving each electrode predominates.

It should be understood, however, that the cycle time of 460 μs is so rapid relative to the delays in cooling at printhead 7 and ribbon 22 that the net effect is one of intermediate temperature, resulting in a bonding of printing to ribbon 22 and lift-off at the printing with ribbon 22.

Figure 5:
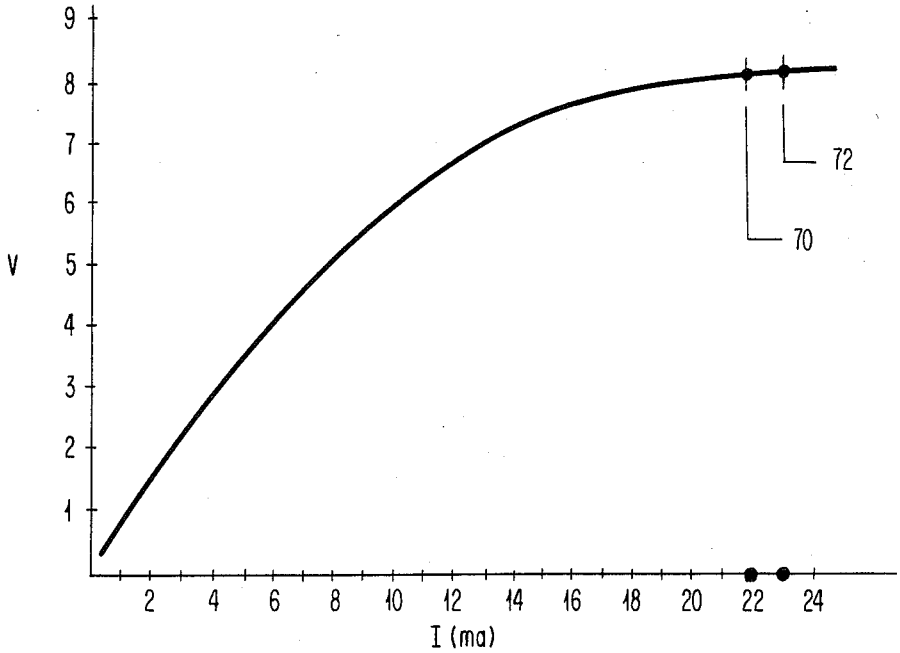
FIG. 5 is a graph of electrode current with respect to voltage for the preferred embodiment.

In a typical implementation employing this invention, the current for printing was 22 ma while the current for erase was 23 ma. The currents were not identical because the final current level is more readily found by successive tests varying the print current, which is more easily implemented than varying the cycle times. FIG. 5 is a plot of the current-to-ribbon-voltage characteristics of a typical ribbon in a range from zero to past the foregoing currents. The response is generally linear at currents substantially lower than the foregoing currents, but the response tends to become level at higher current, indicating that small differences in current at the printing level result in very little differences in voltage across the ribbon. Point 70 on the curve indicates the 22 ma print current while point 72 indicates the 23 ma high level of the erase pulses. The difference in voltage across the ribbon is small.

Driving the ribbon with generally similar levels of current for printing and erase provides consistent, good quality erasures. The machine is adjusted for good printing, and separate adjustments for good erasures are unnecessary. This is particularly true where control 15 is used by a machine operator to select printing density. The effect of higher print current is an increase in the binding of marking material to the surface printed upon. That increase requires that the erase level be within a more limited range than when printing is less strongly bonded to the surface printed upon. In the preferred machine shown, a new erase level corresponding to the new setting of control 15 need not be found, since the erase level is automatically varied directly with the print level.

It will be apparent that this invention can take many alternative forms and that patent coverage should not be limited to the specifics of the implementation described.

What is claimed is:

1. A thermal printer having a power source to power heat-producing elements in a column simultaneously moved across the area of a printed character which can be selectably activated as said elements pass across a character printed while in contact with a thermal transfer medium which forms a bond for lift-off correction of thermal printing from said transfer medium at temperatures above ordinary room temperatures and below a temperature at which printing from said transfer medium is effected, keyboard selection means to select a lift-off correction mode of operation, and means operative during each said lift-off correction mode of operation to apply power from said power source to substantially all of said heat-producing elements as said elements move across said character area, said power being in a series of pulses having the net effect of producing said temperature for lift-off correction and being applied to adjoining of said heat producing elements in substantially equal form and opposite phase.

2. The thermal printer as in claim 1 in which said pulses are square waves having a lower level of substantially zero and an upper level in the order of magnitude of the level of power from said power source to said transfer medium supplied by said printer source prior to operation of said keyboard selection means.

3. The thermal printer as in claim 2 in which said square waves are symmetrical, at least for said heat-producing elements above the bottom part of said column corresponding to an underline of a character.

4. The thermal printer as in claim 1 in which said heat-producing elements in the bottom part of said column corresponding to an underline of a character receive greater power than the other of said elements.

5. The thermal printer as in claim 1 also comprising operator-selectable control means which sets the level of printing power and the level of power from said pulses in one setting.

6. The thermal printer as in claim 2 also comprising operator-selectable control means which sets the level of printing power and the level of power from said pulses in one setting.

7. The thermal printer as in claim 3 also comprising operator-selectable control means which sets the level of printing power and the level of power from said pulses in one setting.

8. The thermal printer as in claim 4 also comprising operator-selectable control means which sets the level of printing power and the level of power from said pulses in one setting.

9. A thermal printer having a power source to power heat-producing elements in a column simultaneously moved across the area of a printed character which can be selectably activated as said elements pass across a character printed while in contact with a thermal transfer medium which forms a bond for lift-off correction of thermal printing from said transfer medium at a temperature above ordinary room temperatures and below temperatures at which printing from said transfer medium is effected, keyboard selection means to select a lift-off correction mode of operation, and means operative during said lift-off correction mode of operation to apply power from said power source to said heat-producing elements in a series of pulses having the net effect of producing said temperature for lift-off correction at areas over printed characters said pulses having a lower level of substantially zero and an upper level in the order of magnitude of the level of power from said power source to said transfer medium suplied by said printer source prior to operation of said keyboard selection means, said pulses applied to adjoining of said heat-producing elements being substantially equal in form and opposite in phase.

10. The thermal printer as in claim 1 in which said pulses are square waves.

11. The thermal printer as in claim 10 in which said square waves are symmetrical, at least for said heat-producing elements above the bottom part of said column corresponding to an underline of a character.

12. The thermal printer as in claim 1 in which said heat-producing elements in the bottom part of said column corresponding to an underline of a character receive greater power than the other of said elements.

13. The thermal printer as in claim 10 in which said heat-producing elements in the bottom part of said column corresponding to an underline of a character receive square waves having a lower level of substantially zero and an upper level substantially the same magnitude as and of longer duration than the upper level of said square waves received by the others of said heat-producing elements.

14. The thermal printer as in claim 11 in which said heat-producing elements in the bottom part of said column corresponding to an underline of a character receive square waves having a lower level of substantially zero and an upper level substantially the same magnitude as and of longer duration than the upper level of said square waves received by the others of said heat-producing elements.

15. The thermal printer as in claim 1 also comprising operator-selectable control means which sets the level of printing power and the level of power from said pulses with one setting.

16. The thermal printer as in claim 10 also comprising operator-selectable control means which sets the level of printing power and the level of power from said pulses with one setting.

17. The thermal printer as in claim 11 also comprising operator-selectable control means which sets the level of printing power and the level of power from said pulses with one setting.

18. The thermal printer as in claim 12 also comprising operator-selectable control means which sets the level of printing power and the level of power from said pulses with one setting.

19. The thermal printer as in claim 13 also comprising operator-selectable control means which sets the level of printing power and the level of power from said pulses with one setting.

20. The thermal printer as in claim 14 also comprising operator-selectable control means which sets the level of printing power and the level of power from said pulses with one setting.

* * * * *

UNITED STATES PATENT AND TRADEMARK OFFICE

CERTIFICATE OF CORRECTION

PATENT NO. : 4,545,693

DATED : October 8, 1985

INVENTOR(S) : John C. Bartlett et al

It is certified that error appears in the above-identified patent and that said Letters Patent is hereby corrected as shown below: On The Title Page:

On the front page of the patent, under FOREIGN PATENT DOCUMENTS add:

0018762 11/1980 European Pat. Off.

0010634 5/1980 European Pat. Off.

Col. 1, line 30, change "a" to read -- of --.

Col. 6, lines 58-59, change "temperatures" to read -- a temperature --.

lines 59-60, change "a temperature" to read -- temperatures --.

Col. 8, line 3, change "1" to read -- 9 --.

Col. 8, line 9, change "1" to read -- 9 --.

Col. 8, line 29, change "1" to read -- 9 --.

Signed and Sealed this

Twenty-fifth Day of October, 1988

*Attest:*

DONALD J. QUIGG

*Attesting Officer*

*Commissioner of Patents and Trademarks*